US010724342B2

(12) United States Patent
MacDonald

(10) Patent No.: US 10,724,342 B2
(45) Date of Patent: Jul. 28, 2020

(54) LOW LOAD COLLET WITH MULTI-ANGLE PROFILE

(71) Applicant: Halliburton Energy Services, Inc., Houston, TX (US)

(72) Inventor: Lorn Scott MacDonald, Inverness (GB)

(73) Assignee: Halliburton Energy Services, Inc., Houston, TX (US)

( * ) Notice: Subject to any disclaimer, the term of this patent is extended or adjusted under 35 U.S.C. 154(b) by 227 days.

(21) Appl. No.: 16/063,919

(22) PCT Filed: Feb. 29, 2016

(86) PCT No.: PCT/US2016/020105
§ 371 (c)(1),
(2) Date: Jun. 19, 2018

(87) PCT Pub. No.: WO2017/151099
PCT Pub. Date: Sep. 8, 2017

(65) Prior Publication Data
US 2019/0003287 A1 Jan. 3, 2019

(51) Int. Cl.
*E21B 23/00* (2006.01)
*E21B 41/00* (2006.01)
*E21B 23/02* (2006.01)

(52) U.S. Cl.
CPC ..... *E21B 41/00* (2013.01); *E21B 23/00* (2013.01); *E21B 23/02* (2013.01)

(58) Field of Classification Search
CPC ..... E21B 23/00; E21B 23/02; E21B 41/00
See application file for complete search history.

(56) References Cited

U.S. PATENT DOCUMENTS 4,749,341 A * 6/1988 Bayh, III ..... E21B 17/003 166/214
9,109,407 B2 8/2015 Inglis et al.
2011/0232897 A1 9/2011 Zweifel
2011/0232898 A1 9/2011 Pendleton et al.
(Continued)

OTHER PUBLICATIONS

International Preliminary Report on Patentability issued in related PCT Application No. PCT/US2016/020105 dated Sep. 13, 2018, 6 pages.

(Continued)

*Primary Examiner* — Robert E Fuller
(74) *Attorney, Agent, or Firm* — Scott Richardson; Baker Botts L.L.P.

(57) ABSTRACT

Systems and methods for actuating a downhole tool using an improved low load collet. The low load collet may include a multi-angle profile that enables the collet to provide a low-load actuation force threshold in one direction, while maintaining a strong interference between the collet and corresponding actuation mechanism. To that end, the collet may include a first protrusion disposed on a first collet spring and a second protrusion disposed on a second collet spring. The first and second protrusions each feature a high-load ramped surface on one side and a low-load ramped surface on an opposite side. The low-load ramped surface of the first protrusion has a shallow angle and the low-load ramped surface of the second protrusion has a steep angle that is larger than the shallow angle.

20 Claims, 11 Drawing Sheets

(56) References Cited

U.S. PATENT DOCUMENTS

| | | | |
|---|---|---|---|
| 2013/0161027 | A1 | 6/2013 | Inglis et al. |
| 2014/0209323 | A1 | 7/2014 | Pisetskiy et al. |
| 2015/0041218 | A1 | 2/2015 | Toler, Jr. |

OTHER PUBLICATIONS

International Search Report and Written Opinion issued in related PCT Application No. PCT/US2016/020105 dated Nov. 22, 2016, 9 pages.

* cited by examiner

LOW LOAD COLLET WITH MULTI-ANGLE PROFILE

CROSS-REFERENCE TO RELATED APPLICATION

The present application is a U.S. National Stage Application of International Application No. PCT/US2016/020105 filed Feb. 29, 2016, which is incorporated herein by reference in its entirety for all purposes.

TECHNICAL FIELD

The present disclosure relates generally to a collet for actuating a downhole component such as a valve and, more particularly, to a low load collet with a multi-angle profile.

BACKGROUND

During drilling and upon completion and production of an oil and/or gas wellbore, a workover and/or completion tubular string can be installed in the wellbore to allow for production of oil and/or gas from the well. Current trends involve the production of oil and/or gas from deeper wellbores with more hostile operating environments. Various downhole tools may be installed within the wellbore, rather than at the surface of the wellbore, to provide operational control in deep wells. These remote tools can be activated within a wellbore based on control line signals, hydraulic actuation mechanisms, and/or mechanical actuation mechanisms.

When a mechanically actuated mechanism is used to activate or deactivate a downhole tool, the mechanical force is typically supplied by a collet deployed within the wellbore on a tubular string. In some instances, collets are designed to provide a differential opening capability of the downhole tool, such as a valve. That is, the collet can open the valve by applying a lower mechanical force in one direction and close the valve by applying a higher mechanical force in the opposite direction. Unfortunately, such collet arrangements used to provide low load mechanical actuation in one direction can increase the potential for the collet to creep in the low load direction during operation of the downhole tool.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

Figure 1:
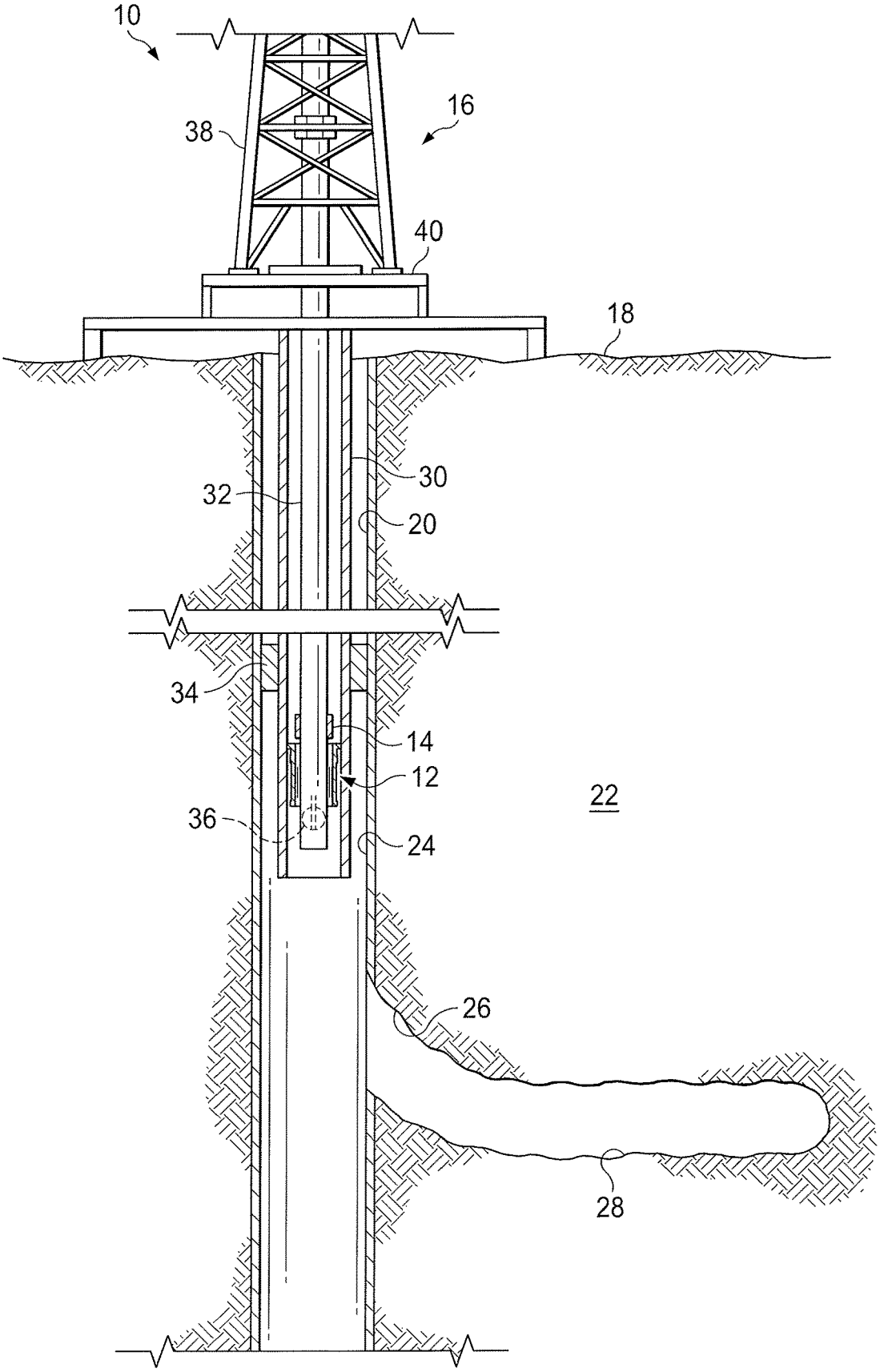
FIG. 1 is a schematic representation of a subterranean formation and a wellbore operating environment, in accordance with an embodiment of the present disclosure.

Illustrative embodiments of the present disclosure are described in detail herein. In the interest of clarity, not all features of an actual implementation are described in this specification. It will of course be appreciated that in the development of any such actual embodiment, numerous implementation specific decisions must be made to achieve developers' specific goals, such as compliance with system related and business related constraints, which will vary from one implementation to another. Moreover, it will be appreciated that such a development effort might be complex and time consuming, but would nevertheless be a routine undertaking for those of ordinary skill in the art having the benefit of the present disclosure. Furthermore, in no way should the following examples be read to limit, or define, the scope of the disclosure.

Certain embodiments according to the present disclosure may be directed to systems and methods for actuating a downhole tool using an improved low load collet. The disclosed low load collet may include a multi-angle profile that enables the collet to provide a low-load actuation force threshold in one direction, while maintaining a strong interference between the collet and corresponding actuation mechanism.

In currently existing low load collets, the collet includes a number of fingers with protrusions formed thereon. The protrusions are shaped with a relatively shallow sloped surface on one side and a relatively steep sloped surface on an opposite side. The shallow sloped surfaces on one end of the protrusions enable the collet to deflect and slide past an actuation mechanism in a first direction under the application of a relatively small force in a first longitudinal direction. The steeper sloped surfaces on the opposite end of the protrusions enable the collet to deflect and slide past the actuation mechanism in an opposite direction under the application of a relatively large force in a second longitudinal direction. This unequal load application may allow the collet to actuate a valve (or other downhole tool) into an open position using a relatively low load, and to actuate the valve closed under a relatively large load. Thus, low load collets generally improve the differential opening capability of valves and other downhole equipment.

In existing low load collets, all of the collet fingers generally have the same angle for the shallow sloped surfaces, to provide the low load actuation functionality. Unfortunately, this consistent shallow slope on the fingers can lead to undesirable movement of the collet, since a relatively low load is able to initiate deflection of the collet fingers. That is, the valve or other downhole tool can start to creep open instead of the collet remaining in a neutral position. The valve can creep open in response to various forces on the collet such as, for example, unexpected set down weight on the shifting tool, the weight of the shifting tool itself, or debris in the well causing a plug.

Attempts to improve the functioning of low load collets have involved moving one or more protrusions to an off-centered position along the length of the collet fingers, or staggering the protrusions relative to each other along the length of the collet fingers. Unfortunately, moving the protrusions in this manner can make it difficult to calculate the forces needed in each direction to actuate a downhole tool using the collet. When such collets are built, they must be subsequently tested to determine the forces that will enable the collet to actuate a downhole tool.

The low load collet with a multi-angle profile disclosed herein is designed to address and eliminate the shortcomings associated with existing low load collets. The disclosed low load collet enables more accurate actuation of downhole tools through the use of multi-angle profiles on the collet springs (fingers). That is, the collet may include a first protrusion disposed on a first collet spring and a second protrusion disposed on a second collet spring. The first and second protrusions each feature a high-load ramped surface on one side and a low-load ramped surface on an opposite side. The low-load ramped surface of the first protrusion has a shallow angle and the low-load ramped surface of the second protrusion has a steep angle that is larger than the shallow angle. In some embodiments, the collet may have several collet springs with protrusions that feature steeper angled surfaces on the low-load side, and these collet springs may be sequenced about the circumference of the collet along with the shallower protrusions.

The steeper angle on the low-load side of one or more collet protrusions may provide a desired level of interference between the collet and an actuation mechanism than is currently available using a collet with similarly sloped low-load sides of all the collet protrusions. Thus, the collet may still provide a low load open, high load close functionality for isolation barrier valves and other downhole equipment, while maintaining a strong interference between the collet and the actuation mechanism. The collet may remain securely connected to the actuation mechanism until the two components are purposefully driven apart, thereby preventing the valve or other downhole tool from creeping open.

Turning now to the drawings, FIG. 1 illustrates an example of a wellbore operating environment 10 in which a collet 12 and actuation mechanism 14 may be used. As depicted, the operating environment may include a workover and/or drilling rig 16 that is positioned on the earth's surface 18 and extends over and around a wellbore 20. The wellbore 20 penetrates a subterranean formation 22 for the purpose of recovering hydrocarbons. The wellbore 20 may be drilled into the subterranean formation 22 using any suitable drilling technique. The wellbore 20 may extend substantially vertically away from the earth's surface 18 over a vertical wellbore portion 24, deviate from vertical relative to the earth's surface 18 over a deviated wellbore portion 26, and transition to a horizontal wellbore portion 28. In other operating environments 10, all or portions of the wellbore 20 may be vertical, deviated at any suitable angle, horizontal, and/or curved. The wellbore 20 may be a new wellbore, an existing wellbore, a straight wellbore, an extended reach wellbore, a sidetracked wellbore, a multilateral wellbore, and other types of wellbores for drilling and completing one or more production zones. Further, the wellbore 20 may be used for both producing wells and injection wells.

A wellbore tubular string 30 and/or a second wellbore tubular string 32 may be lowered into the wellbore 20 for a variety of drilling, completion, workover, treatment, and/or production processes throughout the life of the wellbore 20. The embodiment shown in FIG. 1 illustrates the wellbore tubular 30 in the form of a completion assembly string disposed in the wellbore 20, and the second wellbore tubular 32 is illustrated in the form of a wellbore tubular disposed within the wellbore tubular 30. It should be understood that the wellbore tubular 30 and/or the second wellbore tubular 32 is equally applicable to any type of wellbore tubulars being inserted into a wellbore including as non-limiting examples drill pipe, casing, liners, jointed tubing, and/or coiled tubing. Further, the wellbore tubular 30 and/or the second wellbore tubular 32 may operate in any of the wellbore orientations (e.g., vertical, deviated, horizontal, and/or curved) and/or types described herein. In some embodiments, wellbore casing may be cemented into place in the wellbore 20.

In general, the wellbore tubular 30 and/or the second wellbore tubular 32 may have a different tensile load limit than a compressive load limit. For example, coiled tubing may be subject to buckling when placed under a given compressive load while being capable of supporting the same load in tension. In an embodiment, the unequal load collet disclosed herein may allow a downhole tool to be actuated using a force in each direction that is within the compressive load limit and the tensile load limit of the wellbore tubular 30 and/or the second wellbore tubular 32 used to form the wellbore tubular string. The unequal actuation forces in opposite directions may be desirable since it keeps the actuation device from exceeding the tensile load limit and/or compressive load limit of the wellbore tubular used.

In some embodiments, the wellbore tubular string 30 may include a completion assembly string having one or more wellbore tubular types and one or more downhole tools (e.g., zonal isolation devices 34, screens, etc.) including, for example, the collet 12. In some embodiments, the second wellbore tubular string 32 may be disposed within the wellbore tubular string 30, or may be deployed into the wellbore 20 as an internal part of the wellbore tubular string 30. The internal tubular string 32 may include one or more downhole tools (e.g., valve 36) including, for example, one or more actuation mechanisms 14.

The collet 12 on the first wellbore tubular string 30 may engage and actuate the one or more actuation mechanisms 14 in response to movement of the second wellbore tubular string 32 relative to the first wellbore tubular string 30. As resulting movement of the actuation mechanism 14 may actuate one or more downhole tools on the wellbore strings. The one or more downhole tools may take various forms. For example, the zonal isolation device 34 may be used to isolate the various zones within the wellbore 20 and may include, but is not limited to, a plug, a valve (e.g., lubricator valve, tubing retrievable safety valve, fluid loss valves, etc.), and/or a packer (e.g., production packer, gravel pack packer, frac-pac packer, etc.).

It should be noted that, in other embodiments, the positioning of the collet 12 and the actuation mechanism 14 may be reversed. For example, the actuation mechanism 14 may be coupled with a downhole tool (e.g., valve) and disposed along the first wellbore tubular string 30, while the collet 12 is disposed along the internal wellbore tubular string 32 for engaging and transferring a longitudinal force to the actuation mechanism 14 to actuate the downhole tool.

The workover and/or drilling rig 16 may include a derrick 40 with a rig floor 42 through which the wellbore tubular 30 extends downward from the drilling rig 16 into the wellbore 20. The workover and/or drilling rig 16 may include a motor driven winch and other associated equipment for extending the wellbore tubular 30 and/or the second wellbore tubular 32 into the wellbore 20 to position the wellbore tubular 30 and/or the second wellbore tubular 32 at a selected depth. While the operating environment depicted in FIG. 1 refers to a stationary workover and/or drilling rig 16 for conveying the wellbore tubular 30 and/or the second wellbore tubular 32 within a land-based wellbore 20, in other embodiments, mobile workover rigs, wellbore servicing units (such as coiled tubing units), and the like may be used to lower the outer wellbore tubular 30 and/or the second wellbore tubular 32 into the wellbore 20. It should be understood that the wellbore tubular 30 and/or the second wellbore tubular 32 may be used in other operational environments, such as within an offshore wellbore operational environment.

Regardless of the type of operational environment in which the collet 12 and actuation mechanism 14 are used, it will be appreciated that the collet 12 and the actuation mechanism 14 serve to actuate a downhole device using one force in a first direction and a different force in a second direction. For example, the collet 12 and the actuation mechanism 14 may be used to open the downhole valve 36 using a first force (e.g., a first longitudinal force) in a first direction and then close the valve 36 using a second force (e.g., a second longitudinal force) in a second direction, where the second force may be greater than the first force and the second direction may be different than the first direction. In addition, the collet 12 may be designed to positively lock into a neutral position relative to the actuation mechanism 14 to prevent the downhole valve 36 from creeping open before the desired first force has been applied.

As described in greater detail with reference to FIGS. 2A, 2B, 3A, 3B, 5A, 5B, 6A, and 6B, the collet 12 generally includes a first end 70, a second end 72, a plurality of collet springs 74 with a plurality of slots 76 disposed therebetween, and two or more collet protrusions 78. The collet protrusions 78 may engage an indicator 80 on the actuation mechanism 14 and apply a longitudinal force to the indicator 80 to actuate the downhole tool or device. The actuation mechanism 14 may include a portion of the downhole tool or device configured to be operated through an engagement with the collet 12. In other embodiments, the actuation mechanism 14 may be a separate component from the downhole tool or device, the actuation mechanism 14 being coupled to and configured to actuate the downhole tool or device.

Figure 2A:
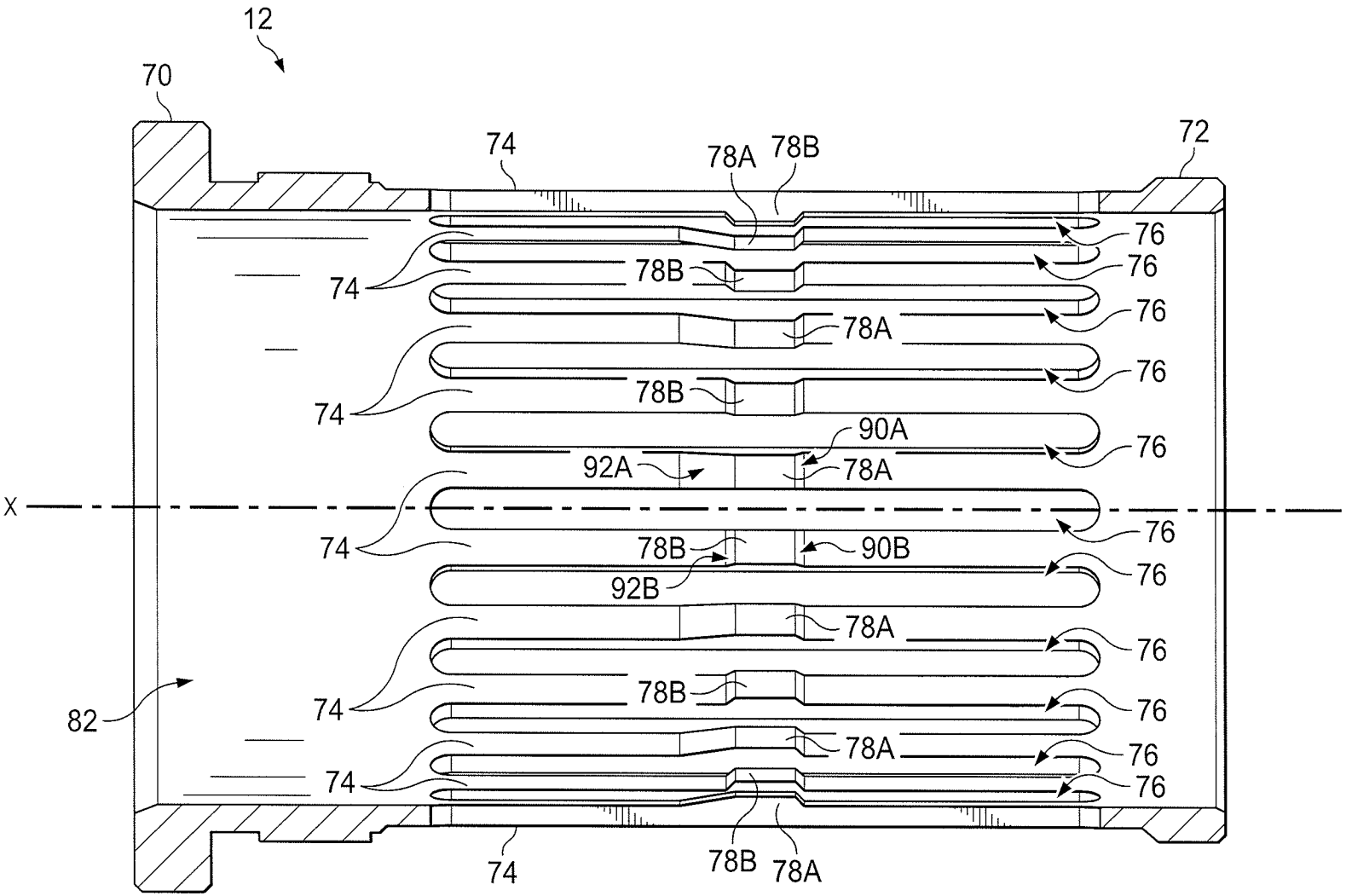
FIGS. 2A-2B are cutaway and perspective views of a low load collet, in accordance with an embodiment of the present disclosure.
Figure 2B:
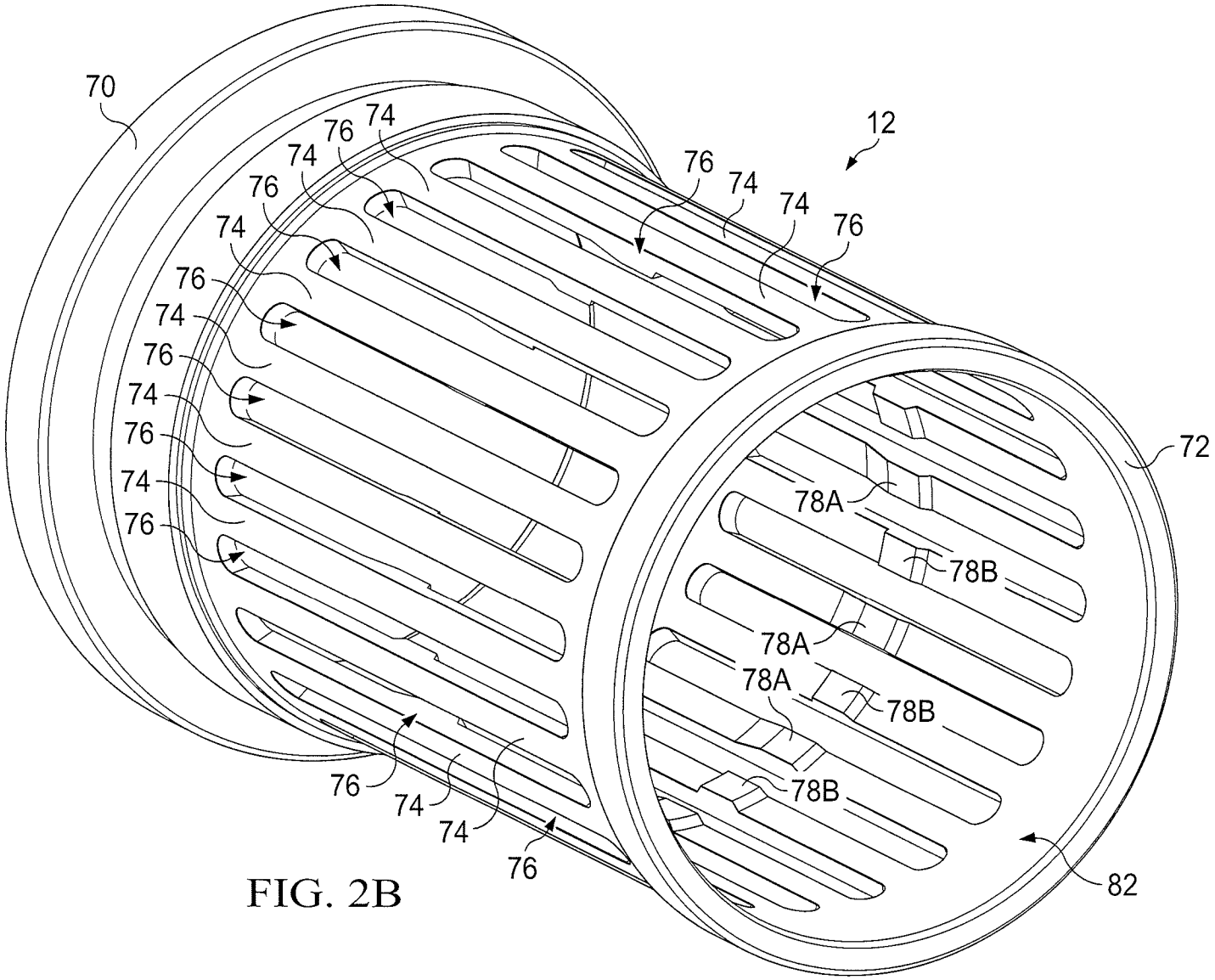

An embodiment of the collet 12 is shown in FIGS. 2A and 2B. The first end 70 of the collet may generally include a tubular mandrel or means. The collet 12 may be sized to fit within a downhole tool, so that the collet 12 may be used as an internal shifting component. A longitudinal flow passage 82 extends through the first end 70 to allow for passage of fluids and/or other components (e.g., actuation mechanism, one or more additional wellbore tubulars, etc.) through the collet 12. The first end 70 of the collet 12 may be coupled to a wellbore tubular by any known connection means. In some embodiments, the collet 12 may be coupled to a wellbore tubular by a threaded connection formed between the wellbore tubular and the first end 70. In other embodiments, the first end 70 of the collet 12 may be coupled to a wellbore tubular through the use of one or more connection mechanisms such as a screw (e.g., a set screw), a bolt, a pin, a weld, and/or the like.

In some embodiments, the second end 72 of the collet 12 may also generally include a tubular mandrel or means. The outer diameter of the second end 72 may be sized to allow the collet 12 to be conveyed within the wellbore and/or within one or more wellbore tubulars disposed within the wellbore. The longitudinal fluid passage 82 extends from the first end 70 through the second end 72 to allow for the passage of fluids and/or other components (e.g., actuation mechanism, one or more additional wellbore tubulars) through the collet 12. The second end 72 of the collet 12 may be coupled to a wellbore tubular by any known connection means. In some embodiments, the second end 72 of the collet 12 may be coupled to a wellbore tubular by a threaded connection formed between the wellbore tubular and the second end 72. In other embodiments, the second end 72 of the collet 12 may be coupled to a wellbore tubular through the use of one or more connection mechanisms such as a screw, a bolt, a pin, a set screw, a weld, and/or the like.

In some embodiments, the second end 72 of the collet 12 may not be coupled to a wellbore tubular. Rather, the second end 72 may be configured to form a guide to aid in directing the collet 12 and a wellbore tubular coupled to the collet 12 through the interior of the wellbore and/or a wellbore tubular. For example, the second end 72 may form a tapered guide (e.g., a mule shoe guide) with an end disposed at a non-normal angle to the longitudinal axis (i.e., axis X of FIG. 2A) of the wellbore. In other embodiments, the second end 72 may not form a guide, but the second end 72 may be coupled to a guide using a threaded connection and/or another connection mechanism. In still other embodiments, the second end 72 may not form a guide or be coupled to a guide.

As mentioned above, the collet 12 may include one or more springs 74 (e.g., beam springs) and/or spring means separated by the slots 76. In some contexts, the springs 74 may be referred to as collet fingers 74. The springs 74 may couple the first end 70 of the collet 12 to the second end 72 of the collet 12. The springs 74 may be configured to form a generally cylindrical configuration about the longitudinal fluid passage 82, which may result from cutting the slots 76 from a single cylindrical mandrel to form the first end 70, the one or more springs 74 and the second end 72.

The one or more springs 74 may be configured to allow for a limited amount of radial expansion in response to a radially expansive force, and/or a limited amount of radial compression of the springs 74 in response to a radially compressive force. The radial expansion and/or compression may allow the collet 12 and the collet protrusion 78 to pass by a restriction in a wellbore and/or in a wellbore tubular while returning to the original diameter once the collet 12 has moved past the restriction. The amount of radial expansion and/or compression may depend on various factors including, but not limited to, the properties of the springs 74 (e.g., geometry, length, cross section, moments, etc.), the radial force applied, and/or the material used to form the springs 74.

In the illustrated embodiment, the collet 12 may include one or more cuts forming the slots 76 between the plurality of springs 74. The slots 76 may allow the collet protrusions 78 to at least partially expand outward (i.e., radially expand) in response to a radially expansive force and/or at least partially compress inward (i.e., radially compress) in response to a radially compressive force, as described in more detail below. The slots 76 may include longitudinal slots, angled slots (as measured with respect to the longitudinal axis X), helical slots, and/or spiral slots for allowing at least some radial expansion in response to a radially expansive force. The configuration of the slots 76 (e.g., their shape, width, length, orientation, and/or dimensions relative to the dimensions of the springs 74) may be designed to determine the spring characteristics of the springs 74 and the corresponding configuration and properties of the collet protrusions 78.

As shown in FIGS. 2A and 2B, some embodiments of the collet 12 may include collet protrusions 78 disposed on inner surfaces of one or more of the plurality of springs 74. Having collet protrusions 78 on the inner surface of the springs 74 may allow the collet 12 to function as an internal shifting collet disposed within and used to actuate a valve or other downhole tool. In presently disclosed embodiments, the collet protrusions 78 may be disposed on two or more springs 74. In some embodiments, the collet protrusions 78 may be disposed one on each of the plurality of springs 74.

With reference to FIGS. 2A, 2B, 3A, and 3B, each collet protrusion 78 is configured to engage the indicator 80 of the actuation mechanism 14. The collet protrusions 78 are thereby designed to produce a longitudinal force (i.e., a force substantially parallel to the axis X) on the indicator 80 and a radial force (e.g., a radially expansive force and/or a radially compressive force) on the springs 74. In some embodiments, the collet protrusions 78 may be configured to engage the indicator 80 at a plurality of surfaces or points and thereby produce the corresponding longitudinal and radial forces at a plurality of points along the length of the springs 74. The configuration of the collet protrusions 78 may be used to determine the force required to move the collet 12 past the indicator 80 in each direction, as described in more detail herein.

As shown in FIGS. 2A, 2B, 3A, and 3B, each collet protrusion 78 generally includes a section of the corresponding spring 74 with a decreased inner diameter. Two or more collet protrusions 78 disposed on two or more springs 74 may extend around the inner surface of the springs 74, and the one or more slots 76 may extend between adjacent collet protrusions 78. The collet protrusions 78 may each include one or more surfaces 90, 92 for engaging and/or contacting the indicator 80 disposed on the actuation mechanism 14, an inner wellbore tubular, and/or a component thereof such as a downhole tool.

In some embodiments, the surfaces 90, 92 may be disposed at generally obtuse angles taken with respect to the inner surface of the springs 74. These angles may allow for a radially expansive force to be applied to the springs 74 when the collet protrusion 78 contacts the corresponding indicator 80 on the actuation mechanism 14. As described in detail below, the angle between the inner surface of the springs 74 and the surface 90 may be the same or different than the angle between the inner surface of the springs 74 and the surface 92. In some embodiments, the edges formed between the surfaces 90, 92 and the inner surface of the collet protrusion 78 may be rounded or otherwise beveled to aid in the movement of the collet protrusion 78 past the indicator 80.

In present embodiments, the collet 12 may be configured such that it functions as a low-load collet. The term "low-load collet" may refer to a collet 12 that is designed to actuate a downhole tool with a first force in a first direction and with a second force in a second direction opposite the first direction, with the first force being different from the second force. To that end, each of the collet protrusions 78 may include a low load ramped surface 92 on one side and a high load ramped surface 90 on the opposite side. One or more of the low load ramped surfaces 92 may be angled from the inner surface of their respective collet springs 74 at a relatively shallow angle, while the high load ramped surfaces 90 may be angled from the inner surface of the collet spring 74 at a relatively steeper angle.

The low load ramped surfaces 92 on one end of the collet protrusions 78 may enable the collet 12 to deflect and slide past the indicator 80 in a first direction under the application of a relatively small force in a first longitudinal direction. The high load ramped surfaces 90 on the opposite end of the collet protrusions 78 may enable the collet 12 to deflect and slide past the indicator 80 in an opposite direction under the application of a relatively large force in a second longitudinal direction. This unequal load application may allow the collet 12 to actuate a valve (or other downhole tool) into an open position using a relatively low load, and to actuate the valve closed under a relatively large load. Thus, the low-load collet 12 may generally improve the differential opening capability of valves and other downhole equipment.

In present embodiments, the collet 12 is configured such that not all of the collet springs 74 have the same snapping angle present on them for actuating the downhole tool in the low-load direction. That is, at least one of the collet springs 74 may have a differently shaped collet protrusion 78 extending therefrom, as compared to another of the collet springs 74. As shown in FIGS. 2A, 2B, 3A, 3B, 5A, 5B, 6A, and 6B, one or more collet protrusions 78A may have low-load ramped surfaces 92A with a relatively shallow angle, while one or more other collet protrusions 78B may have low-load ramped surfaces 92B with a relatively steep angle, this steep angle being larger than the shallow angle of the surfaces 92A.

As shown, all the collet protrusions 78 disposed on the collet springs 74 are generally aligned with each other at a relatively central location along the length of the collet 12. However, the angles of the low-load ramped surfaces 92 on alternating or sequenced fingers may be different from one another. These differing angles may enable the collet 12 to be positively locked in place relatively to the indicator 80, for example, while significantly reducing the peak snap-through load value to approximately that of a collet with all shallow angles on the low-load side. The shallower angled surfaces 92A may enable the collet 12 to be pushed past the indicator in the low-load direction under a relatively low longitudinal force. The steeper angled surfaces 92B may prevent the collet 12 from creeping or otherwise moving past the indicator when the desired low longitudinal force is not actively being applied by the system. In this way, the one or more steep angled surfaces 92B may lock the collet 12 in a neutral position until the desired low-load force is actually applied, thereby preventing the collet 12 from accidentally actuating the downhole tool.

The disclosed multi-angle collet 12 may help to keep the actuation mechanism 14 from moving until a desired time. The multi-angled ramped surfaces 92 of the collet protrusions 78 may keep the load required to actuate the actuation mechanism 14 in the low load direction relatively small (compared to the high load direction), while providing a positive lock to keep the actuation mechanism from moving early. Although an operator might need to apply a relatively high initial load to start the collet 12 moving relative to the actuation mechanism 14 in the low load direction, the higher angled surfaces 92B may keep the collet 12 locked in a desired position prior to the application of this force, so that the collet 12 does not creep relative to the actuation mechanism 14.

In some embodiments, the steep angle of the low-load surfaces 92B may be within a range of approximately 30 to 80 degrees. However, other relatively "steep" angles may be utilized in other embodiments. In some embodiments, the shallow angle of the low-load surfaces 92A may be within a range of approximately 5 to 30 degrees, although any desirable angle that is less than the relatively steep angle of the low-load surfaces 92B may be utilized. The high-load surfaces 90 of the differently shaped protrusions 78A and 78B may have approximately the same steep angle (e.g., 60 degrees, 80 degrees, etc.) for facilitating movement of the collet 12 relative to the actuation mechanism 14 under a relatively high longitudinal load. In some embodiments, the steep angled low-load surfaces 92B may have approximately the same angle as the high-load surfaces 90 for those particular collet protrusions 78. In other embodiments, the angles may be different between the high-load surface 90 and the steep angled low-load surfaces 92B.

All the collet protrusions 78 are generally aligned with each other along the length of the collet 12. As a result, it may be relatively easy to determine the necessary peak snap loads for moving the collet 12 in either direction relative to the indicator, using existing snap load calculation/simulation techniques. In systems where collet protrusions are offset relative to each other along the length of the collet, the existing snap load calculations cannot be used. Instead, these collets have to be physically load tested to determine the forces needed to move the collets in either direction. The disclosed collet 12 may allow for improved reliability of snap load determination since the existing calculations can be used (new calculations do not have to be developed), as well as a reduced need for modifications to the angles, detents, or widths of the collet protrusions after initial load testing.

When a certain load is desired for actuating the collet 12 in the low load direction, the shallow angles for the low-load surfaces 92A may be determined by simply modifying the slope of low-load surfaces that are currently being used (without steep angled surfaces) to facilitate this low load actuation. By lowering the slope of the angled surfaces 92A from what is currently used, this may reduce the overall snap load of the multi-angle collet 12 in the low load direction back to what it would have been if all the angles were shallow. For example, if the original shallow angle is 10 degrees on all collet protrusions to produce a desired snap load for actuating the collet 12 in the low load direction, the new design may have a number of protrusions with steep angled surfaces 92B (to provide a positive lock) and the remaining angled surfaces 92A may be adjusted to about 8 degrees to balance out the total snap load.

As shown, the differing angles on the protrusions 78 may be used in a sequence on the collet springs 74. Specifically, the collet protrusions 78 may alternate between the shallow ramped surfaces 92A on the low-load side and the steep ramped surfaces 92B on the low-load side. It should be noted that other sequences of the differently shaped collet protrusions 78 may be utilized in other embodiments. For example, some embodiments of the collet 12 may feature every third, fourth, fifth, sixth, or seventh (and so forth) collet protrusion 78 about the circumference of the collet 12 as having a low-load ramp surface 92B with a steeper angle. In some embodiments, the collet 12 may include one or more additional groups of collet protrusions 78 designed with other angles on the low-load surfaces 92 (i.e., not equal to the "shallow" angle of surfaces 92A or the "steep" angle of surfaces 92B).

Any desirable patterns, iterations, or arrangements of collet protrusions 78 with differently angled low-load sides 92 may be applied in the presently disclosed collet 12. The patterns or arrangements could be symmetrical around the circumference of the collet 12, as illustrated. In other embodiments, however, the arrangements may not be symmetrical. In some embodiments, the collet 12 may include just a single collet protrusion 78 with a relatively steep angled low-load surface 92B, to provide the desired interference.

Figure 3A:
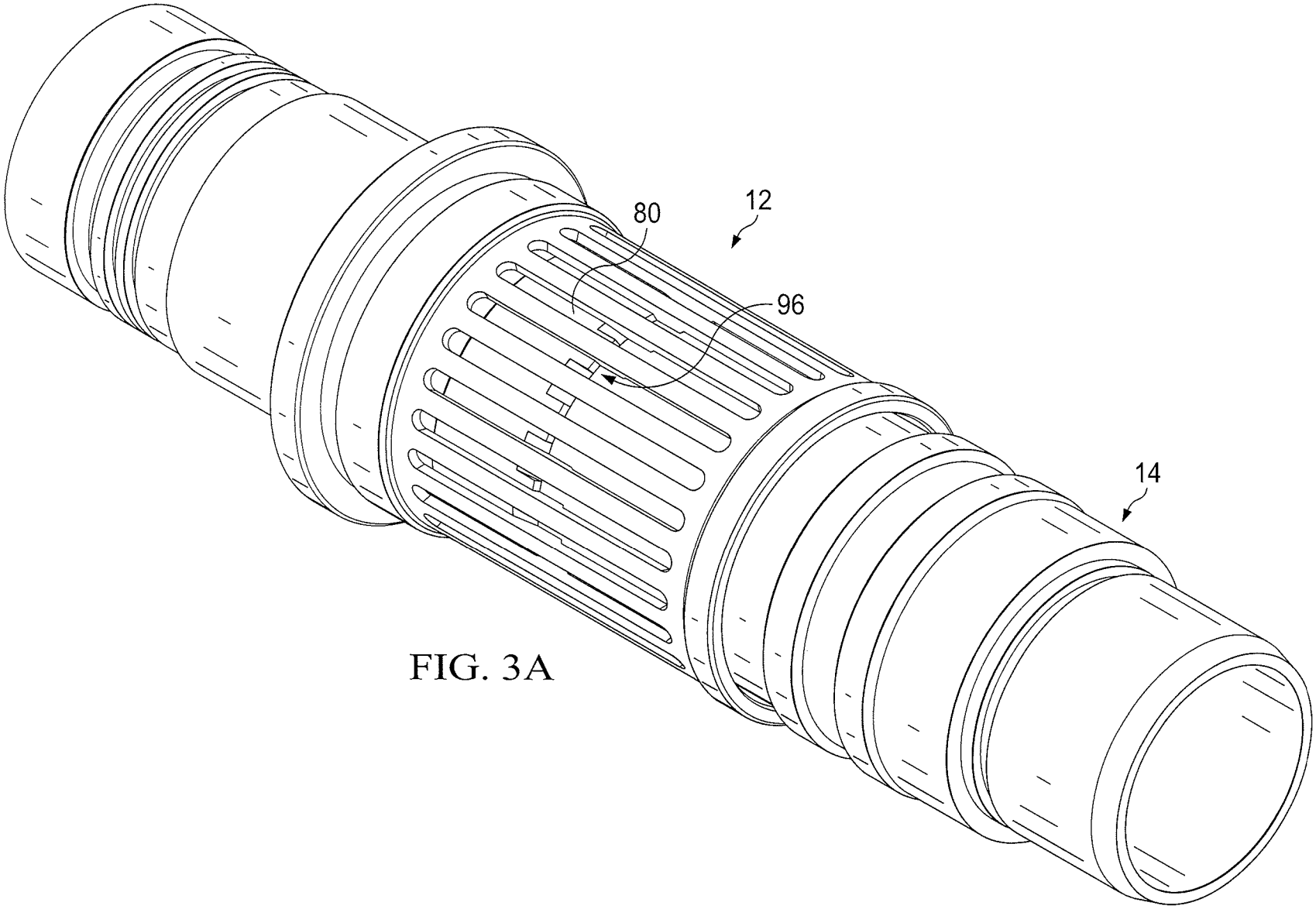
FIGS. 3A-3B are cutaway and perspective views of the low load collet of FIGS. 2A-2B on a mandrel, in accordance with an embodiment of the present disclosure.
Figure 3B:
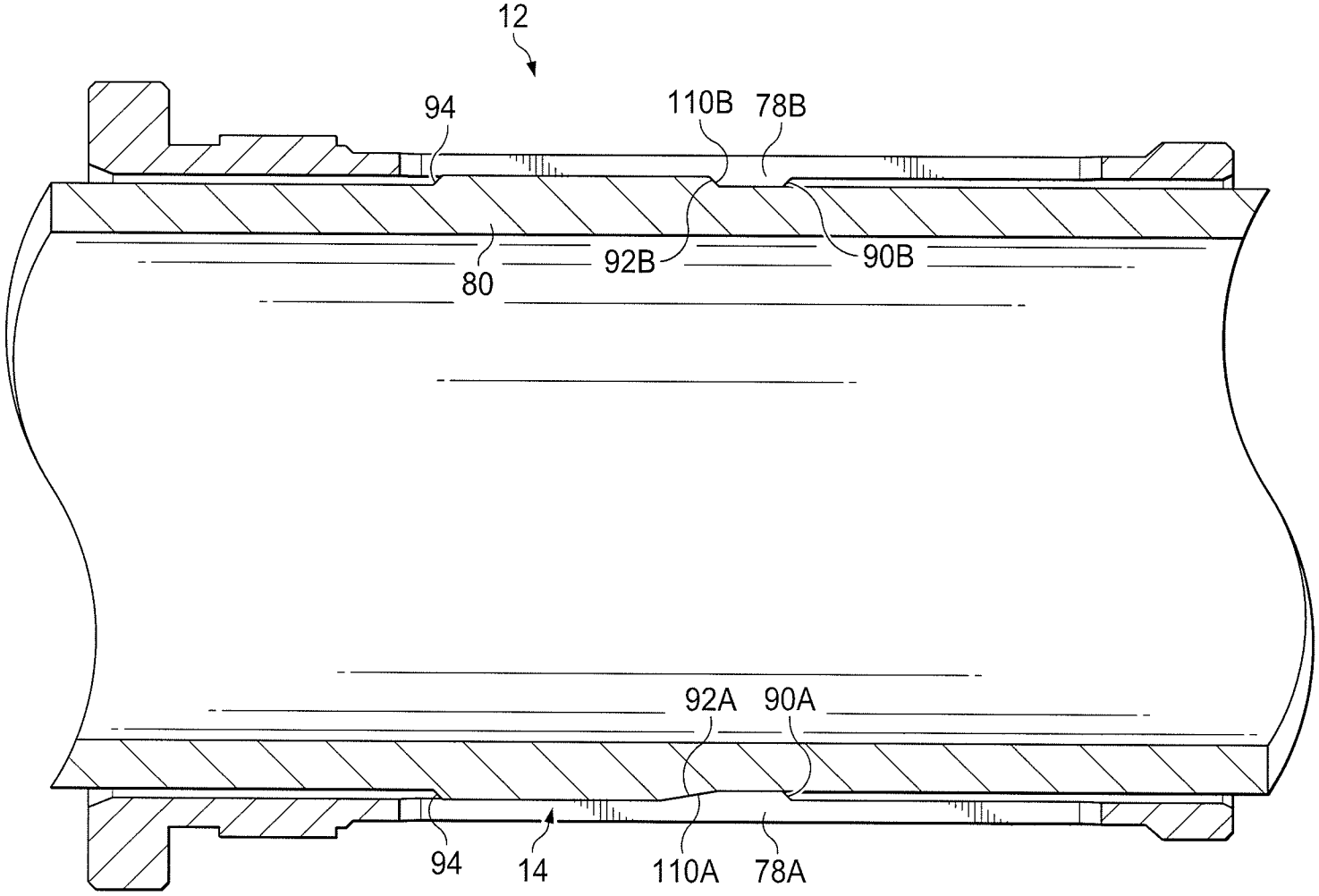

An embodiment of the multi-angled collet 12 interacting with the actuation mechanism 14 is shown in FIGS. 3A and 3B. The indicator 80 may be generally coupled to the actuation mechanism 14, an internal wellbore tubular, and/or a part of a downhole tool. The indicator 80 may be configured to engage the multi-angle collet protrusions 78 to produce the longitudinal and radial forces at one or more points along the springs 74. The indicator 80 and the actuation mechanism 14 may be generally configured to resist radial movement and may be configured to withstand greater radially compressive and/or radially expansive loads than the springs 74 of the collet 12. The downhole tool and/or actuation mechanism 14 may be configured to allow for an amount of longitudinal translation in response to an applied longitudinal force resulting from the engagement of the collet 12 and the indicator 80. As a result, the engagement between the collet protrusions 78 and the indicator 80 may produce an amount of longitudinal translation of the indicator 80 and/or the actuation mechanism 14 followed by a radial expansion and/or a radial compression of the springs 74 to allow the collet 12 to pass by the indicator 80.

In the illustrated embodiment, the indicator 80 may include a section of the actuation mechanism 14, wellbore tubular, and/or downhole tool component with an increased outer diameter, and the collet 12 may pass outside the actuation mechanism 14. In other embodiments as described in more detail below, the indicator 80 may include a section of the actuation mechanism 14, wellbore tubular, and/or downhole tool component with a decreased inner diameter, such that the collet 12 may pass inside the actuation mechanism 14. The indicator 80 may include one or more surfaces 94, 96 for contacting the surfaces 90, 92 of the collet protrusions 78. In some embodiments, the surfaces 94, 96 may be disposed at generally obtuse angles taken with respect to the outer surface of the actuation mechanism 14. This angle may allow for a radially expansive force to be applied to the springs 74 when the collet protrusions 78 engage the indicator 80. In some embodiments, the angles of the surfaces 94, 96 may correspond to the angles of the surfaces 90, 92 on the collet protrusions 78. In other embodiments, however, these angles may be different. The angle between the outer surface of the actuation mechanism 14 and the surface 94 may be the same or different than the angle between the outer surface of the actuation mechanism 14 and the surface 96. In some embodiments, the edges formed between the surfaces 94, 96 and the outer surface of the indicator 80 may be rounded or otherwise beveled to aid in the movement of the collet protrusions 78 past the indicator 80.

The collet protrusions 78 may generally have a height configured to engage the indicator 80. As used herein the height of the collet protrusions 78 may refer to the radial distance that the inner surface of the collet protrusions 78 extend beyond the inner surface of the corresponding springs 74. Similarly, the indicator 80 may have a height sufficient to allow for an engagement with the collet protrusions 78. The interference distance represents the amount of radial overlap between the collet protrusions 78 and the indicator 80, and is the amount by which the collet springs 74 may be displaced in order to allow the collet 12 to pass by the indicator 80.

The radial expansion and/or radial compression of each spring 74 through the interference distance results from the engagement of a surface (e.g., surface 94) of the indicator 80 with a surface (e.g., a surface 90) of the collet protrusion 78 at a point of engagement. A portion of the force resulting from the engagement between the corresponding surfaces is directed in a longitudinal direction (i.e., along axis X) and a portion of the force is directed in a radial direction. The portion of the force directed along the longitudinal direction may be transferred to the actuation mechanism 14 to actuate one or more downhole tools or components. When the longitudinal resistance of the indicator 80 rises above a threshold (e.g., when the actuation mechanism 14 moves to an actuated state, for example reaching a stop or a maximum translation position), the radial force may also increase. As the radial force applied to the spring 74 at the point of engagement exceeds a first force required to displace the spring 74 through the interference distance, the collet protrusion 78 may pass by the indicator 80.

Similarly, when the actuation mechanism 14 is conveyed in a second direction relative to the collet 12, a surface (e.g., surface 96) of the indicator 80 may engage a surface (e.g., surface 92) of the collet protrusion 78 at a point of engagement. The longitudinal force resulting from the engagement of the indicator 80 with the collet protrusion 78 may be transferred to the actuation mechanism 14 to actuate one or more downhole tools or components. When the longitudinal resistance of the indicator 80 rises above a threshold (e.g., when the actuation mechanism 14 moves to an actuated state), the radial force may also increase. As the radial force applied to the spring 74 at the point of engagement exceeds a second force required to displace the spring 74 through the interference distance, the collet protrusion 78 may pass by the indicator 80.

Figure 4:
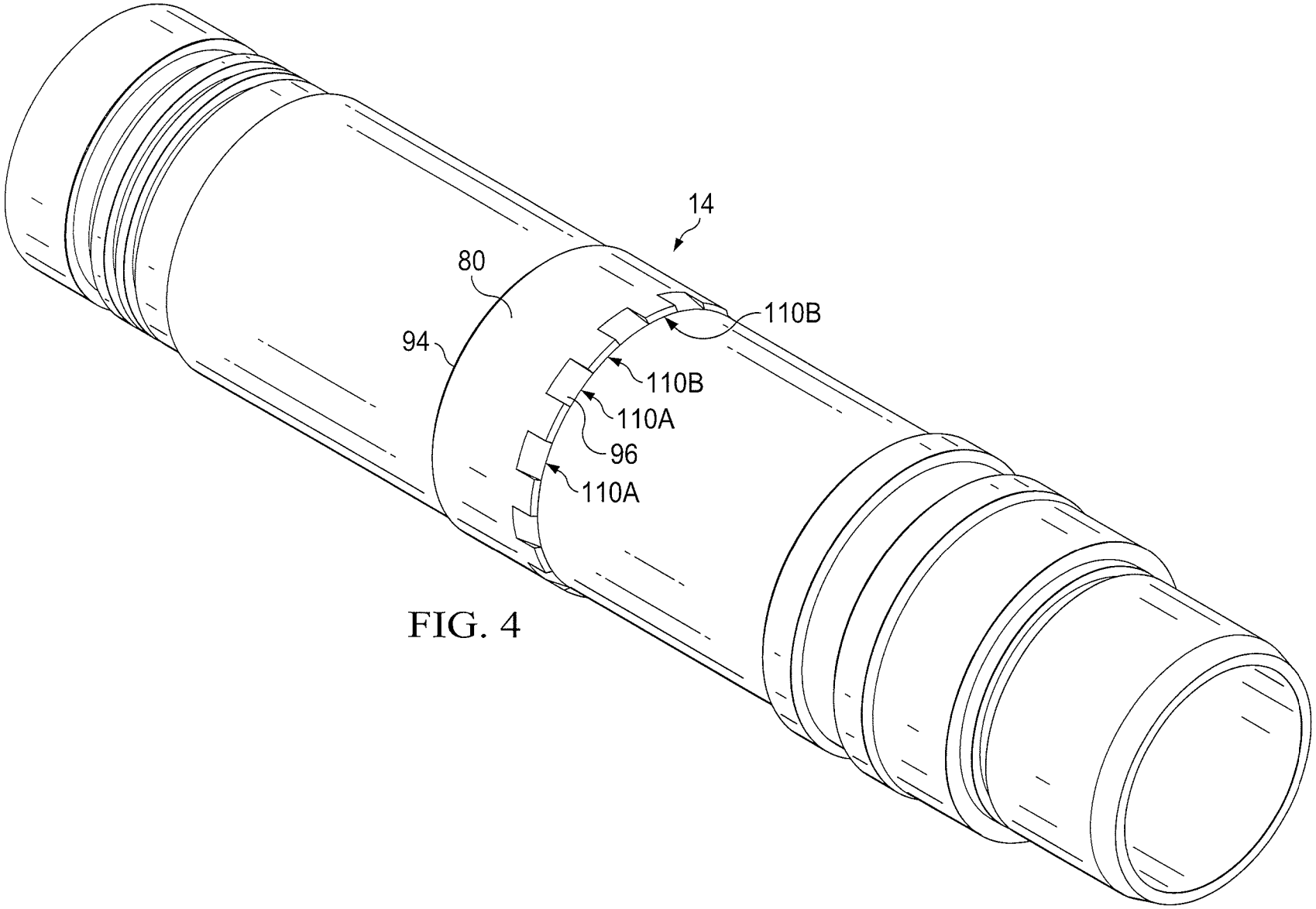
FIG. 4 is a perspective view of the mandrel of FIGS. 3A-3B, in accordance with an embodiment of the present disclosure.

As shown in FIGS. 3A, 3B, and 4, the indicator 80 may be designed to specifically match the multi-angled profile of the corresponding collet 12. For example, the indicator 80 may include alternating shallow ramps 110A and steep ramps 110B to match the profile of the low-load surfaces 92A and 92B of the collet protrusions 78. That is, the shallow ramps 110A of the indicator 80 may be aligned with and match the profile of the shallow angled low-load surfaces 92A of the collet protrusions 78A. The steep ramps 110B of the indicator 80 may be aligned with and generally match the profile of the steep angled low-load surfaces 92B of the collet protrusions 78B. This arrangement may allow the different angled surfaces to each load up uniquely and at approximately the same time when a load is applied between the collet protrusions 78 and the indicator 80.

Figure 5A:
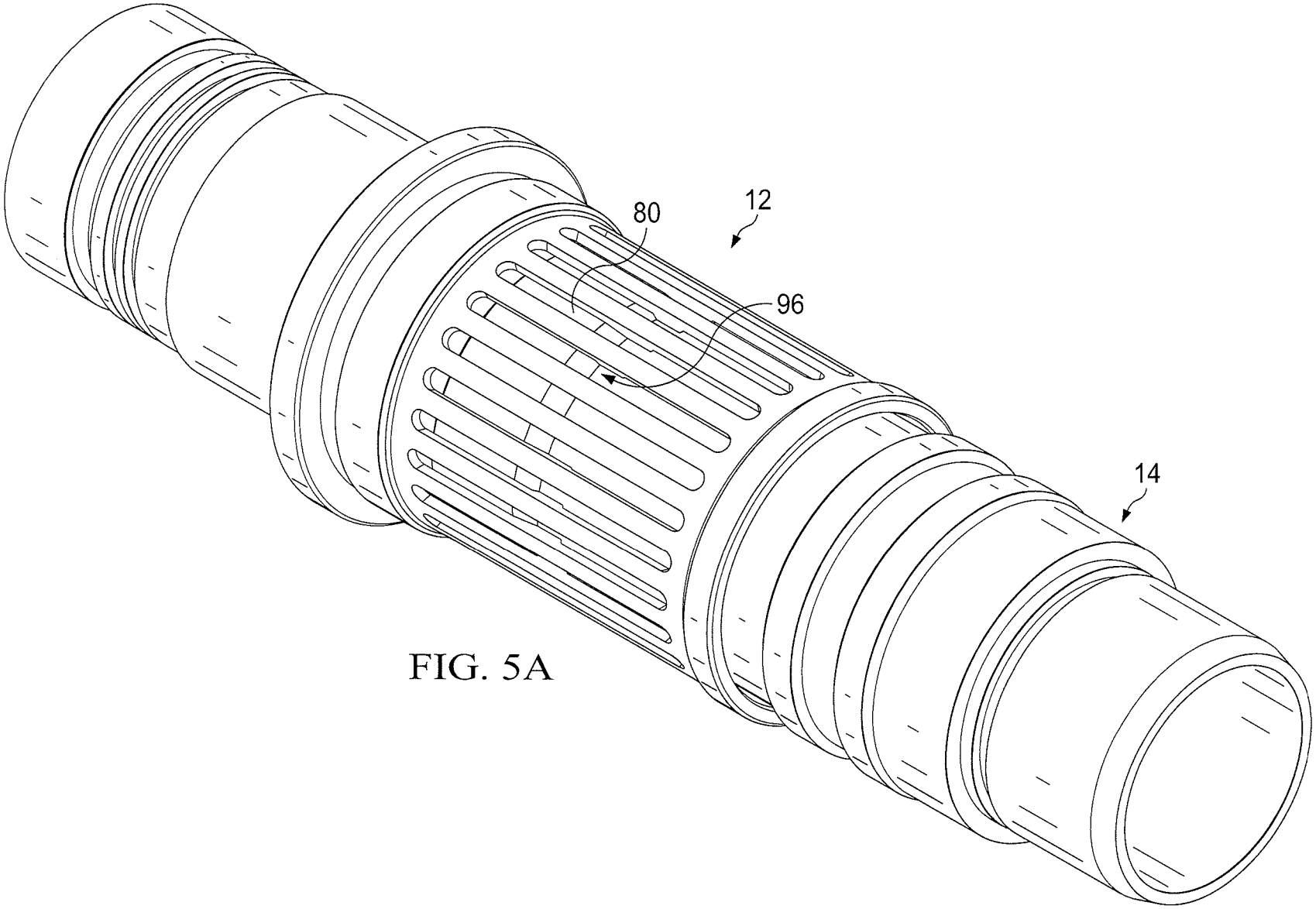
FIGS. 5A-5B are cutaway and perspective views of the low load collet of FIGS. 2A-2B on another mandrel, in accordance with an embodiment of the present disclosure.
Figure 5B:
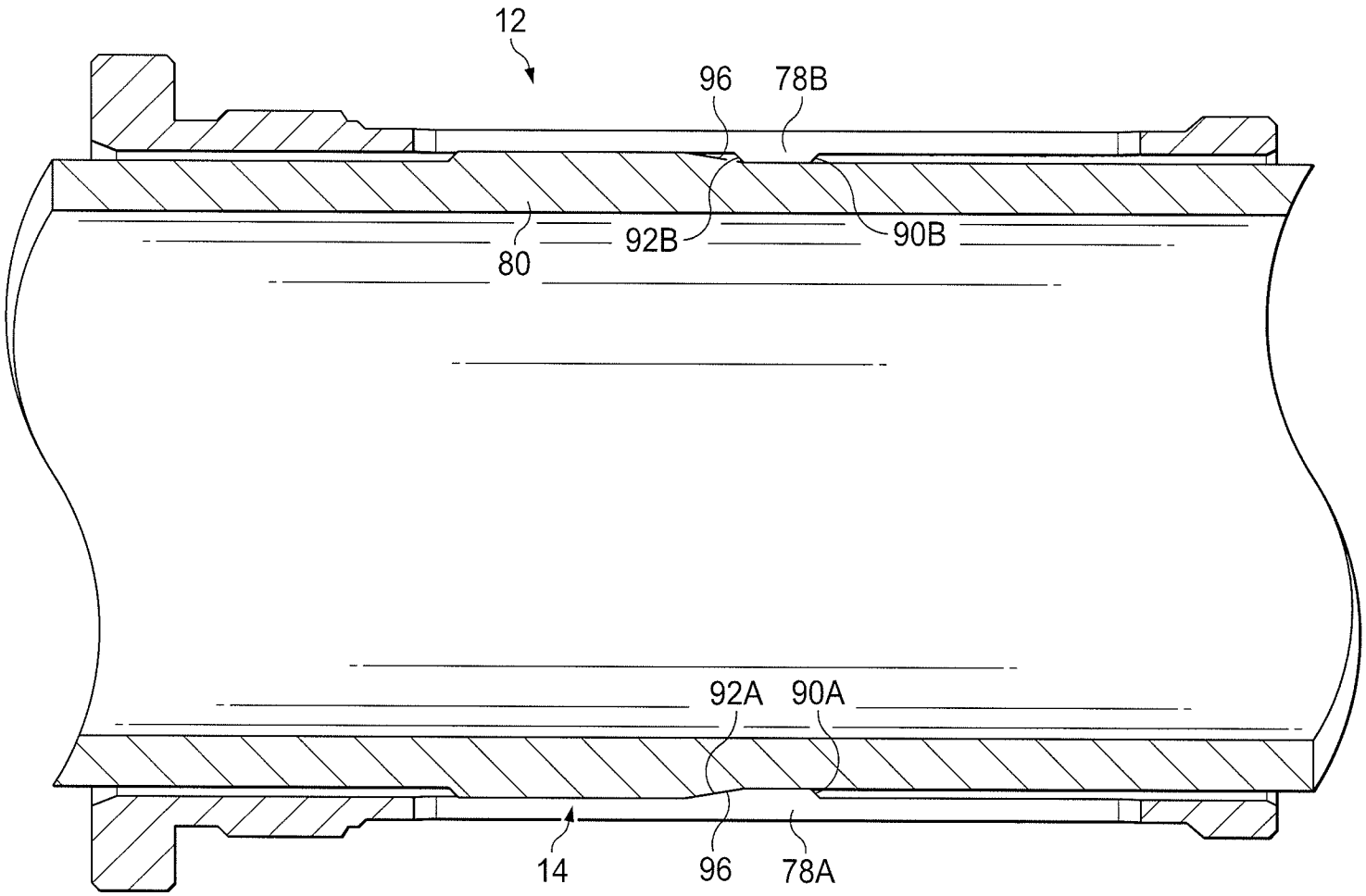

In another embodiment shown in FIGS. 5A and 5B, the surface 96 of the indicator 80 may not include different angles that match the profile of the differently shaped collet protrusions 78. Instead, the surface 96 may include a consistently shallow angle around the circumference of the actuation mechanism 14. When this arrangement is used, the collet protrusions 78A and 78B with differently angled low-load surfaces 92A and 92B may interface with the indicator surface 96 at different times as the collet 12 moves relative to the actuation mechanism 14.

Figure 6A:
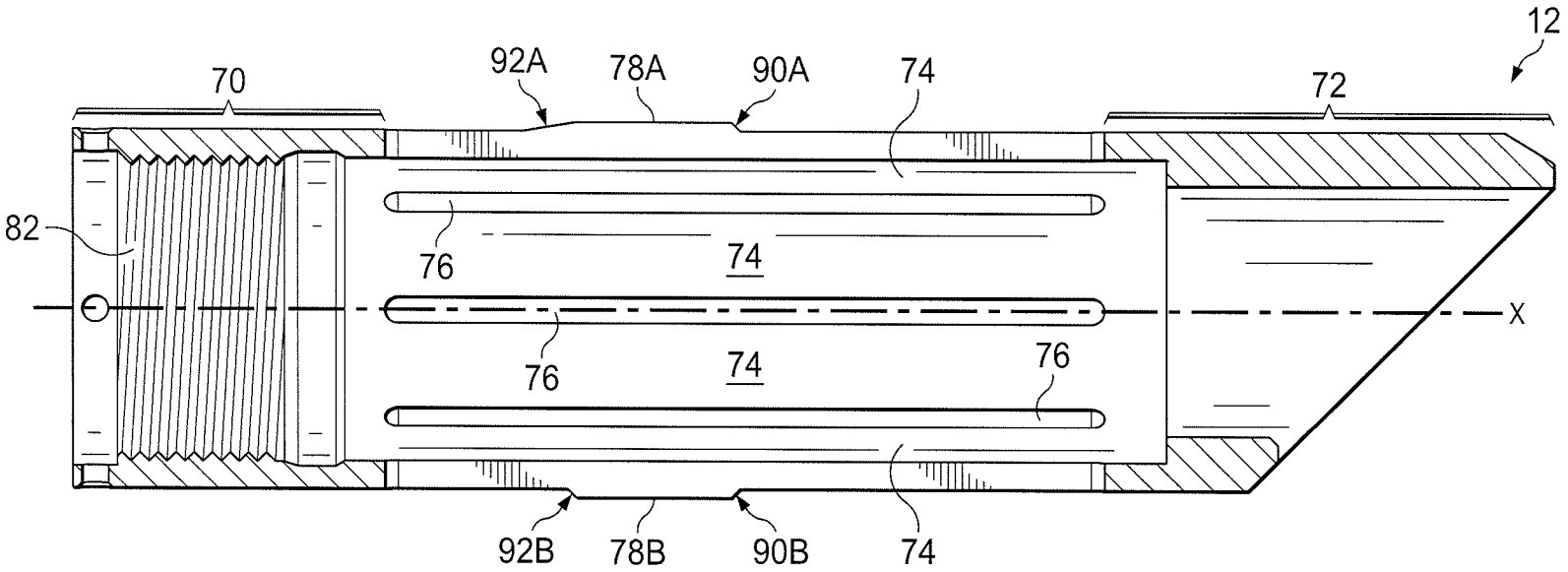
FIGS. 6A-6B are cutaway and perspective views of a low load collet with outwardly facing protrusions, in accordance with an embodiment of the present disclosure.
Figure 6B:
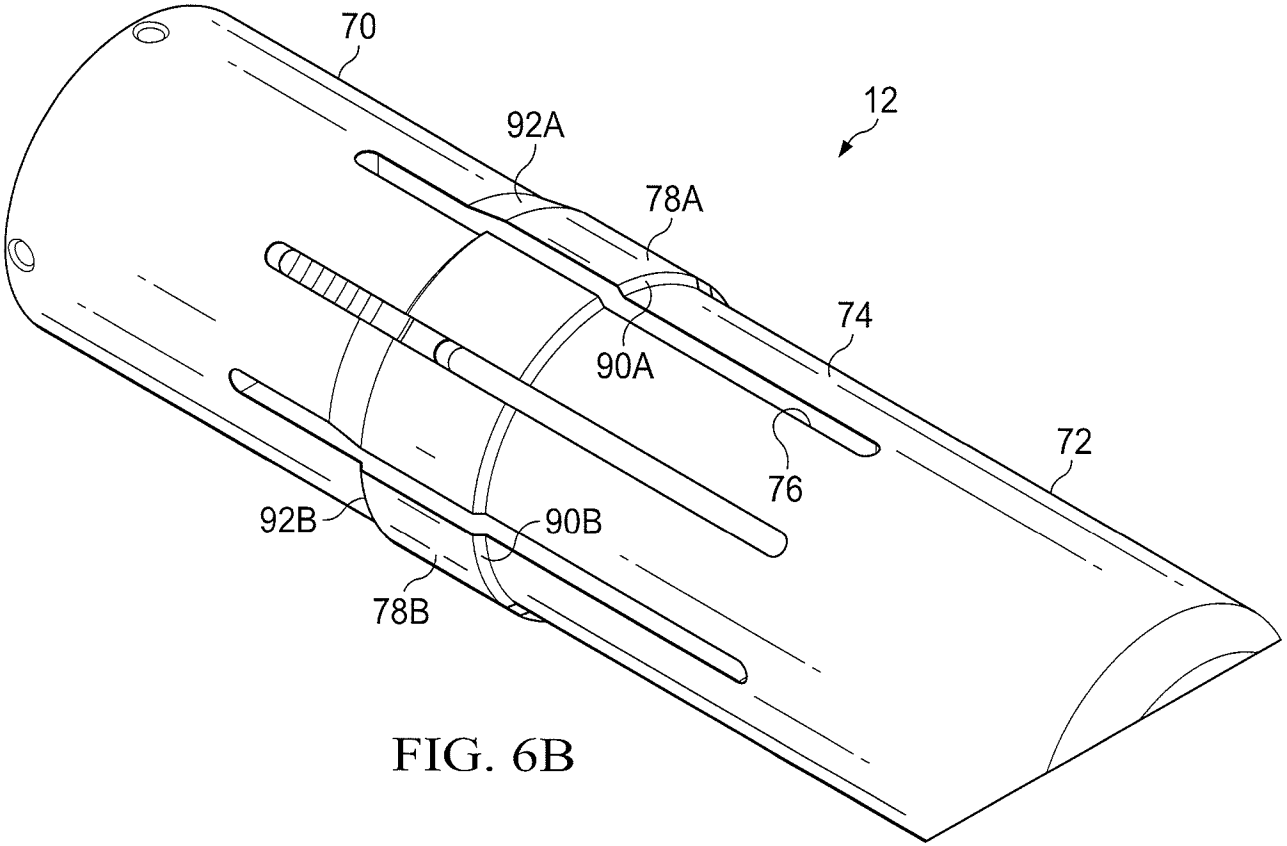

Another embodiment of the collet 12 is illustrated in FIGS. 6A and 6B. The illustrated collet 12 includes many features similar to those of the multi-angle collet 12 described above. That is, the collet 12 may include the first end 70, the second end 72, the plurality of collet springs 74 with a plurality of slots 76 disposed therebetween, and a longitudinal fluid passage 82 extending through the collet 12. The collet 12 also includes collet protrusions 78 disposed on an outer surface of two or more of the springs 74 that may interact with an indicator disposed, for example, on an inner surface of an actuation mechanism, wellbore tubular, and/or downhole tool component. Thus, the illustrated collet 12 may have a reversed profile from the embodiments described above. In this embodiment, the collet 12 is an outer diameter profile collet having the multi-angle profile described above. This arrangement of the collet 12 may reduce the cost and complexity of manufacturing the collet 12, compared to the "inverse" collet described in the above embodiments. In such an embodiment, the collet 12 may function as an external collet that is conveyed on a separate tool string from the surface to shift the actuation mechanism.

The one or more springs 74 may be configured to allow for a limited amount of radial compression in response to a radially compressive force during the engagement of the collet protrusions 78 with the one or more surfaces (94, 96) of an indicator (not shown). The indicator may be coupled to an inner surface of a wellbore tubular and/or as a part of a downhole tool or actuation mechanism (14). The indicator may be configured to engage the collet protrusions 78 to produce longitudinal and radial forces at one or more points along the springs 74. The indicator and the actuation mechanism may be generally configured to resist radial movement and may be configured to withstand greater radial expansive loads than the springs 74 of the collet 12. As a result, the engagement between the collet protrusions 78 and the indicator may produce a radial compression of the springs 74 through an interference distance rather than a radial expansion of the actuation mechanism when the longitudinal resistance is above a threshold.

Any of the considerations related to configuring the multi-angled profile of the collet protrusions 78 relative to the outer surface of the springs 74 may be applied to the collet 12. This may allow a downhole device to be actuated with one force in a first direction and with a different force in a second direction, while facilitating positive locking of the collet 12 in a neutral position when not being used to actuate the downhole device, as was discussed previously with respect to the collet 12 of FIGS. 2A, 2B, 3A, 3B, 5A, and 5B.

Returning to FIGS. 3A, 3B, 5A, and 5B, the indicator 80 may form a portion of an actuation mechanism 14 for actuating a downhole tool or component. The actuation mechanism 14 may generally be configured to produce a movement in a downhole tool through a translation of one or more components of the actuation mechanism 14. As discussed above, the translation may be a longitudinal translation and may be achieved through the engagement of the indicator 80 with one or more surfaces of the collet protrusion 78. The surfaces 90, 92 of the collet 12 may be configured to provide one longitudinal force to actuate the actuation mechanism 14 in a first direction and a different longitudinal force to actuate the actuation mechanism 14 in a second direction. The corresponding actuation mechanism 14 may be configured to actuate in response to one longitudinal force in a first direction and the different longitudinal force in the second direction.

Any of a variety of actuation mechanisms 14 with a feature configured to act as the indicator 80 may be used with the collet 12 disclosed herein. The actuation mechanism 14 may be coupled to and configured to actuate one or more devices including, but not limited to, a plug, a valve (e.g., a lubricator valve, tubing retrievable safety valve, fluid loss valves, etc.), a flow control device (e.g., a shifting sleeve, a selective flow device, etc.), a zonal isolation device (e.g., a plug, a packer such as a production packer, gravel pack packer, frac-pac packer, etc.), a sampling device, a portion of a drilling completion, a portion of a completion assembly, and any other downhole tool or component that is configured to be mechanically actuated by the translation of one or more components.

Figure 7:
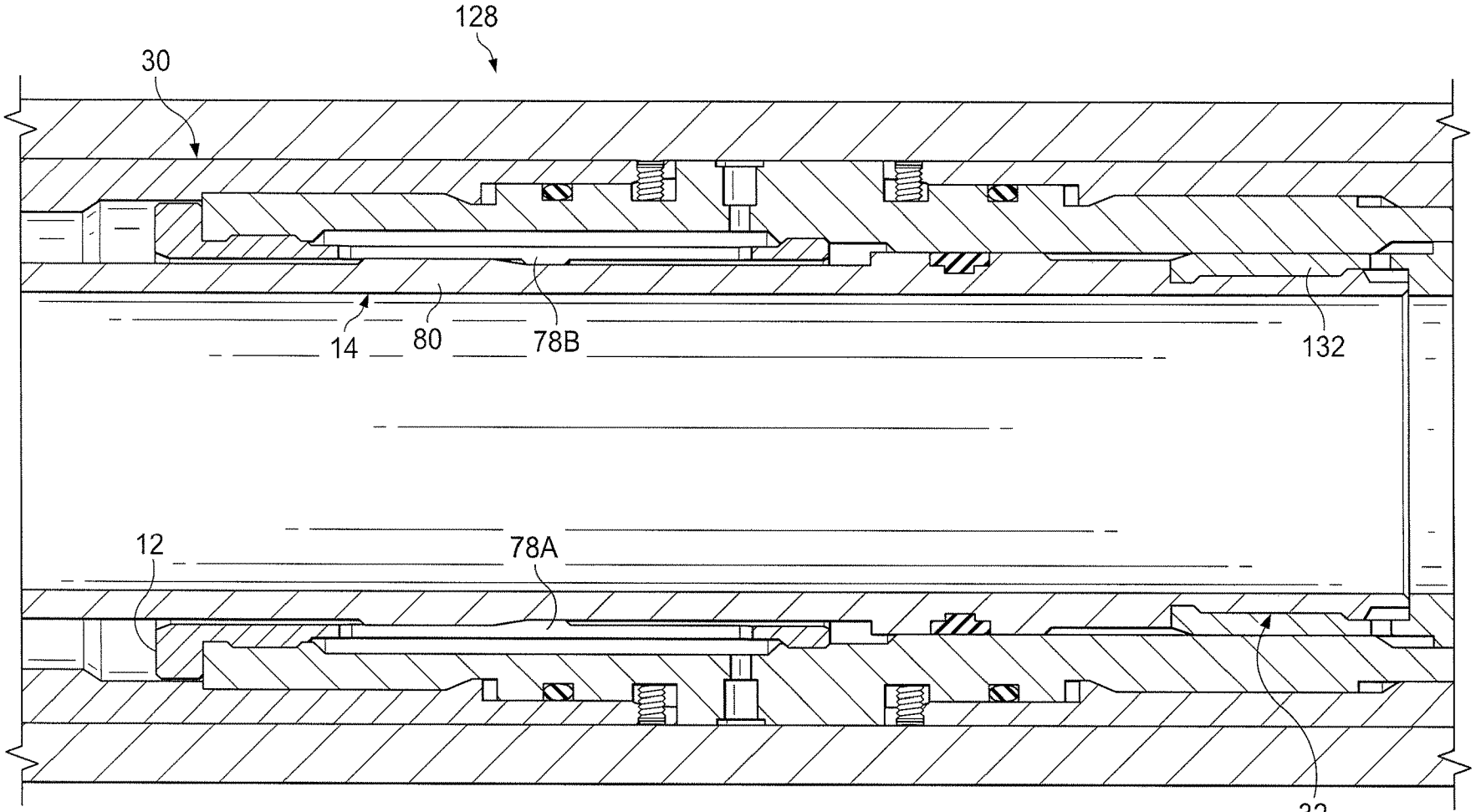
FIG. 7 is a cutaway view of a valve being actuated by the low load collet of FIGS. 2A-2B, in accordance with an embodiment of the present disclosure.

In some embodiments, the actuation mechanism 14 may be coupled to a valve such as a ball valve. As shown in FIG. 7, a ball valve assembly 128 includes an embodiment of the collet 12 and the actuation mechanism 14 used to actuate a ball valve (not shown) having a variety of components to provide a seal (e.g., a ball/seat interface). While an example actuation mechanism 14 and process is described with respect to a ball valve assembly 128, it should be understood that the actuation mechanism 14 providing the longitudinal translation may be used with any of a variety of downhole tools.

In the illustrated embodiment, the actuation mechanism 14 may include or may be coupled to an actuation member 132 used to move the ball valve between open and closed positions. Movement of the actuation mechanism 14 having the indicator 80 may result in actuation of the ball valve via the actuation member 132. With reference to FIGS. 1 and 7, the wellbore tubular string 30 having the multi-angled collet 12 and the wellbore string 32 having the actuation mechanism 14 are parts of a single completion string that forms the ball valve assembly 128 and its associated components. In some embodiments, the ball valve assembly 128 may also include a sub-surface safety valve, a fluid loss valve, and/or a lubricator valve. The collet 12 may be used to actuate the ball valve between a closed position and an open position. As the second wellbore tubular string 32 is conveyed within the wellbore tubular string 30, the indicator 80 of the actuation mechanism 14 may be conveyed into proximity with the collet 12.

In this embodiment, the collet 12, including the surfaces of the collet protrusions 78, may be configured so that the first force applied to the actuation mechanism 14 to actuate the ball valve to an open position may be less than the second force applied to the actuation mechanism 14 to actuate the ball valve to a closed position. Prior to applying the first (relatively low) force to the actuation mechanism 14, the steeper angled surface(s) on the low-load side of the collet protrusions 78B may keep the ball valve from creeping open.

Although the present disclosure and its advantages have been described in detail, it should be understood that various changes, substitutions and alterations can be made herein without departing from the spirit and scope of the disclosure as defined by the following claims.

What is claimed is:

1. A system comprising:
an actuation mechanism comprising an indicator;
a wellbore tubular; and
a collet for interfacing with the indicator of the actuation mechanism, wherein the collet is coupled to the wellbore tubular and comprises:
a first protrusion disposed on a first collet spring; and
a second protrusion disposed on a second collet spring;
wherein the first and second protrusions each comprise a high-load ramped surface on one side and a low-load ramped surface on an opposite side, wherein the high-load ramped surfaces of each protrusion are located at a same longitudinal position along the wellbore tubular; and wherein the low-load ramped surface of the first protrusion has a shallow angle and the low-load ramped surface of the second protrusion has a steep angle that is larger than the shallow angle.

2. The system of claim 1, wherein the first and second protrusions each comprise the high-load ramped surface for applying a first longitudinal force to the indicator in a first direction, and the low-load ramped surface for applying a second longitudinal force to the indicator in a second direction, wherein the first longitudinal force is different than the second longitudinal force.

3. The system of claim 1, wherein the indicator on the actuation mechanism comprises a low-load surface having a shallow ramp for interfacing with the shallow angle of the first protrusion, and a steep ramp for interfacing with the steep angle of the second protrusion.

4. The system of claim 1, wherein the indicator on the actuation mechanism comprises a low-load surface having a consistently sloped angle around a circumference of the actuation mechanism for interfacing with the shallow angle of the first protrusion and the steep angle of the second protrusion.

5. The system of claim 1, further comprising a downhole tool, wherein the actuation mechanism is coupled to the downhole tool to produce a movement in the downhole tool in response to translation of the actuation mechanism.

6. The system of claim 5, wherein the downhole tool comprises a device selected from the group consisting of: a plug, a valve, a lubricator valve, a tubing retrievable safety valve, a fluid loss valve, a flow control device, a zonal isolation device, a sampling device, a portion of a drilling completion, a portion of a completion assembly, and any combination thereof.

7. A collet comprising:
a first collet spring;
a second collet spring;
a first protrusion disposed on the first collet spring; and
a second protrusion disposed on the second collet spring;
wherein the first and second protrusions each comprise a high-load ramped surface on one side and a low-load ramped surface on an opposite side, wherein the high-load ramped surfaces of each protrusion are located at a same longitudinal position along the collet; and wherein the low-load ramped surface of the first protrusion has a shallow angle and the low-load ramped surface of the second protrusion has a steep angle that is larger than the shallow angle.

8. The collet of claim 7, further comprising a plurality of protrusions disposed on a corresponding plurality of collet springs, wherein the plurality of protrusions each comprise a high-load ramped surface and a low-load ramped surface, wherein the low-load ramped surfaces of at least one protrusion has the shallow angle and the low-load ramped surfaces of at least two other protrusions have the steep angle, and wherein the at least one protrusion having the shallow angle is sequenced with the protrusions having the steep angle.

9. The collet of claim 7, wherein the high-load ramped surface of the first protrusion and the high-load ramped surface of the second protrusion each have the same angle.

10. The collet of claim 7, wherein the steep angle is between approximately 30 and 80 degrees.

11. The collet of claim 7, wherein the shallow angle is between approximately 5 and 30 degrees.

12. The collet of claim 7, wherein the first protrusion and the second protrusion are in alignment with each other along a length of the corresponding first and second collet springs.

13. The collet of claim 7, wherein the first and second protrusions are disposed on an inner surface of the corresponding first and second collet springs.

14. The collet of claim 7, wherein the first and second protrusions are disposed on an outer surface of the corresponding first and second collet springs.

15. A method of actuating a downhole tool comprising:
disposing a collet coupled to a wellbore tubular into a wellbore, wherein the collet comprises a first protrusion disposed on a first collet spring and a second protrusion disposed on a second collet spring;
applying a first longitudinal force to an actuation mechanism in a first direction via a high-load ramped surface of the first protrusion and a high-load ramped surface of the second protrusion interfacing with an indicator on the actuation mechanism; and applying a second longitudinal force to the actuation mechanism in a second direction via a low-load ramped surface of the first protrusion and a low-load ramped surface of the second protrusion interfacing with the indicator on the actuation mechanism, wherein the low-load ramped surface of the first protrusion has a shallow angle and the low-load ramped surface of the second protrusion has a steep angle that is larger than the shallow angle.

16. The method of claim 15, further comprising maintaining a positive locking interference between the collet and the actuation mechanism via the low-load ramped surface having the steep angle when the collet is disposed in a neutral position.

17. The method of claim 15, further comprising engaging the first protrusion with the indicator and the second protrusion with the indicator at approximately the same time to apply the second longitudinal force.

18. The method of claim 15, further comprising engaging the first protrusion with the indicator and engaging the second protrusion with the indicator at different times to apply the second longitudinal force.

19. The method of claim 15, further comprising passing the collet by the actuation mechanism in response to the first longitudinal force or the second longitudinal force exceeding a threshold.

20. The method of claim 19, wherein passing the collet by the actuation mechanism comprises:

applying a radial force to the first and second protrusion at the low-load ramped surface or the high-load ramped surface;

radially displacing the collet spring through an interference distance; and conveying the collet past the indicator.

* * * * *